US005921541A

United States Patent [19]

Hänsch

[11] Patent Number: 5,921,541

[45] Date of Patent: Jul. 13, 1999

[54] SUCTION DEVICE WITH BENDING TEMPLATE

[75] Inventor: Egon Hänsch, Wetzikon, Switzerland

[73] Assignee: Ferag AG, Hinwil, Switzerland

[21] Appl. No.: 08/741,046

[22] Filed: Oct. 30, 1996

[30] Foreign Application Priority Data

Nov. 13, 1995 [CH] Switzerland ..... 03203/95

[51] Int. Cl.[6] ..... B65H 3/46

[52] U.S. Cl. ..... 271/106; 271/107; 271/103

[58] Field of Search ..... 271/106, 104, 271/103, 107, 108; 294/64.1; 269/21; 248/362, 363

[56] References Cited

U.S. PATENT DOCUMENTS

| | | | |
|---|---|---|---|
| 1,861,605 | 6/1932 | Maass | 271/104 |
| 1,929,361 | 10/1933 | Liljebladh | 271/106 |
| 2,215,458 | 9/1940 | Backhouse | 271/103 |
| 2,563,450 | 8/1951 | Battey | 271/106 |
| 2,745,665 | 5/1956 | Labombarde | 271/106 |
| 2,850,279 | 9/1958 | Stoothoff et al. | 271/103 |
| 3,039,767 | 6/1962 | Staines | 271/106 |
| 3,773,318 | 11/1973 | Glaser et al. | 271/106 |
| 3,826,485 | 7/1974 | Shindo | 271/106 |
| 4,177,983 | 12/1979 | Wossler | 271/106 |
| 5,535,997 | 7/1996 | Croyle et al. | 271/12 |

FOREIGN PATENT DOCUMENTS

| | | | |
|---|---|---|---|
| 54-115871 | 9/1979 | Japan | 271/106 |
| 962 016 | 6/1964 | United Kingdom . | |
| 1 380 490 | 1/1975 | United Kingdom . | |

*Primary Examiner*—Boris Milef
*Assistant Examiner*—Patrick Mackey
*Attorney, Agent, or Firm*—Walter C. Farley

[57] ABSTRACT

A suction device for handling light, flat and bendable articles has a suction line and a sucker at an end of the suction line. The sucker has a suction lip made of an elastically deformable material for individually contacting and lifting articles. A lip-deforming bending template having a deforming edge defining a concave shape is displaceable relative to the suction lip so that the suction lip is deformed by contact with the deforming edge to conform to the concave shape. A second bending template can be laterally spaced from the suction lip and have a bending edge for contacting an article lifted by the suction lip, the lip being displaceable relative to the bending edge.

10 Claims, 4 Drawing Sheets

Fig.4
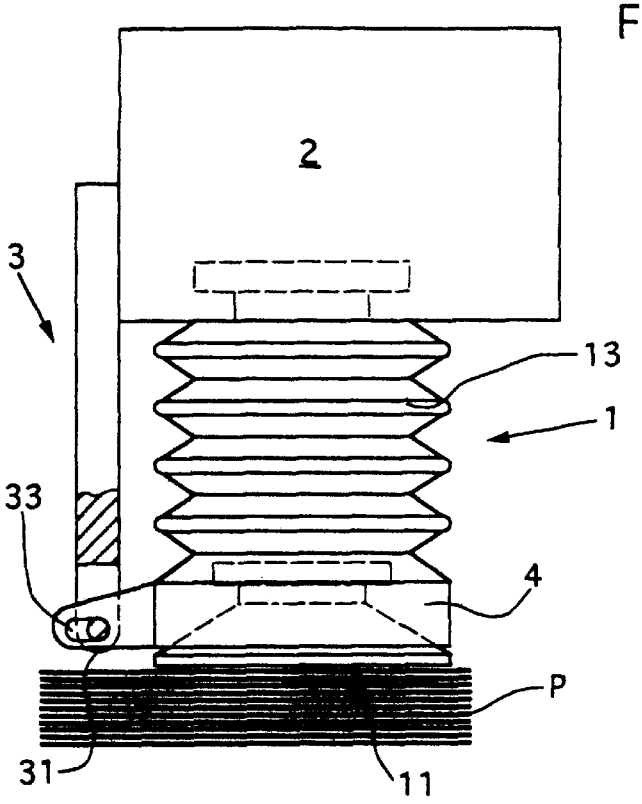
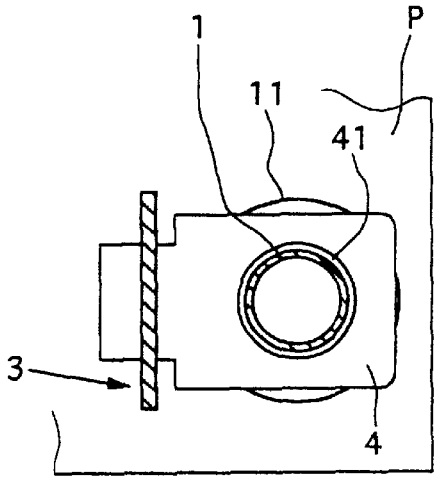
Fig.3
Fig.5
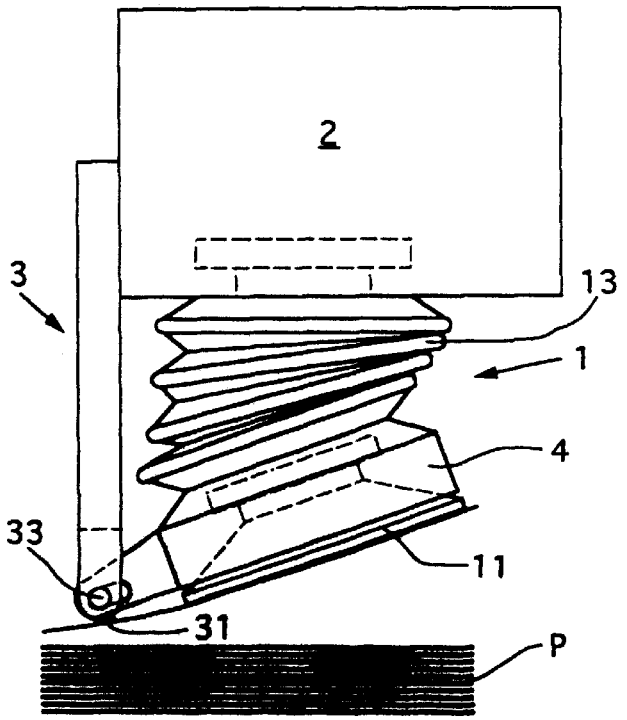

SUCTION DEVICE WITH BENDING TEMPLATE

FIELD OF THE INVENTION

The invention concerns a suction device comprising a sucker on an end of a suction line with a suction lip circumscribing a generally planar suction opening and being positionable on a product to be gripped. With the suction device items are actively gripped and moved, especially light, flat items such as e.g. blank or printed sheets of paper or printed products consisting of several layers of paper.

BACKGROUND OF THE INVENTION

According to the state of the art suction devices are e.g. used to grip sheets of paper or items consisting of several layers of paper and to separate them from a stack. Such suction devices consist of an elastically deformable sucker which is arranged at the end of a suction line. For separating the gripped item from the stack, this end of a suction line is movable relative to the stack or the sucker is movable relative to the end of the suction line. The sucker is thus lowered onto the stack, evacuated and lifted off the stack together with the gripped uppermost item. Hereby the relative positions of the stack and the sucker in a lowered position as well as the coordination of the movement of the sucker, the evacuation and the strength of the suction force produced by the vacuum must be very carefully adjusted to suit each other. This is especially the case if the items to be gripped are very lightweight and not fully tight and if it is important that only one item is gripped at a time. This however is often not possible with a sufficient security for items which are difficult to handle even when things are very well matched.

The publication DE-19603040 describes a suction device which works reliably in the most varied applications. This means in other words that e.g. when using the described suction device, with high reliability only one product is lifted from a stack in each cycle. This suction device is characterized in that it carries out a pre-travel combined with a pre-depression by the combined effect of which the product to be lifted can easily be separated from the stack or from a corresponding support and is then actually lifted. Pre-stroke and predepression precede a stroke and an end-evacuation and they are forcibly coupled. Hereby the pre-depression is higher (nearer to ambient pressure) than the end-evacuation. The pre-depression is such that it is just sufficient to separate an area of the product to be moved from a stack or support and that it is not sufficient for the full movement of the product. By using the pre-travel with the less forceful pre-depression it is possible to reduce the probability of gripping more than one product and it becomes possible to extend the application range of suction devices to softer, more lightweight and less tight products.

SUMMARY OF THE INVENTION

The present invention has the object of bringing development further in this direction. In other words, a suction device for handling at high cycle numbers with greater reliability, products which are even more difficult to handle is provided. For the application of separating stacked products, this means also that with the inventive suction device the probability of gripping more than one product at a time can be lowered without losing speed and without larger expense for supporting devices even for products which are difficult to handle.

The suction device according to the invention comprises (as suction devices according to the state of the art do) a sucker with a suction lip, wherein the suction lip circumscribes a suction opening and can be brought into contact with a product to be gripped. The sucker is arranged on the open end of a suction line. The end of the suction line is, according to the specific function allocated to the suction device, mostly cyclically moveable. In the inventive suction device the sucker is arranged on the end of the suction line such that the suction lip is displaceable relative to the end of the suction line, preferably by forced control, such that it can be in at least two positions (starting position and pre-travel position), having in the two positions two different distances from the end of the suction line. This kind of forcibly controlled movement is e.g. controlled by a depression inside the sucker and is the pre-travel mentioned before.

The inventive suction device further comprises a bending template. The pre-travel shifts the suction lip relative to the bending template. The bending template can be arranged laterally distanced from the sucker such that a product gripped by the sucker is bent around the bending template by the pre-travel of the suction lip. Hereby the form of the suction lip is substantially maintained. The bending template can also be arranged in the area of the sucker such that the pre-travel brings the suction lip into contact with the bending template by which it is deformed such that the suction opening circumscribed by the deformed suction lip is no longer in a plane but takes on a concave, bent form. Thus a product gripped by the suction lip is also bent. Combinations of the named arrangements of bending template and suction lip are also possible, a first bending template being arranged laterally distanced from the sucker and a second bending template in the area of the sucker. A product gripped by the sucker is then during the pre-travel of the suction lip firstly bent around the first bending template and secondly bent together with the suction lip by the second bending template. Hereby it is advantageous to design and arrange the two bending templates such that the bending radii of the two generated bends are bends in opposite directions and lie in two planes which are more or less parallel to each other. Furthermore the bending template or bending templates are advantageously designed and arranged such that a product gripped and bent during pre-travel has smaller bending radii than a product gripped by the same sucker but without bending templates.

Because the product is not only lifted but also bent during the pre-travel of the suction lip, an elastic tension which increases during the pre-travel and a correspondingly increasing elastic force which drives the product away from the sucker are created. An identical force develops in a second product positioned under the first product to be gripped if this further product is also lifted and bent by a residual suction force which is caused by the permeability of the first product next to the suction lip. The suction force on the second product is lower than the one on the first product but the force caused by the bending is identical for both products. The position and/or form of the bending template, by which the bending radius is defined, and the suction effect of the suction device must therefore be coordinated for a specific product type such that the residual suction force is smaller than the elastic force at full pre-travel of the suction lip. Thus the gripping of a second product is prevented because the second product can initially be gripped together with the first, but the second product falls back when the elastic force becomes larger than the residual suction force. The same can be said regarding a second product which is initially moved together with the product to be gripped, not due to a residual suction force resulting from a permeability of the first product but due to an adhesion resulting from corresponding surface properties or from static load.

The inventive suction device which comprises at least one bending template can be a suction device according to the German publication mentioned earlier which is designed such that it does not only comprise a forcibly controlled pre-travel but also a preferably forcibly controlled pre-depression. However, it can also be a different suction device comprising a preferably forcibly controlled pre-travel.

The preferred embodiment of the inventive suction device has, as described above, at least one suction lip displaceable relative to the end of the suction line (pre-travel) and a bending template which is substantially stationary relative to the end of the suction line. In principle, a relative movement between bending template and suction lip is necessary. This can also be achieved by using a displaceable bending template and a stationary suction lip (both displaceable relative to the end of the suction line).

A preferred application of the inventive suction device is the separation of products from a stack, whereby in each cycle the uppermost product on the stack is gripped. Obviously, the inventive suction device can also be used for a plurality of further applications in which suction devices or other means for gripping relatively light products with an at least limited flexibility are used. In many applications the suction device is arranged displaceably which however is not a condition. The suction device can also be arranged to be stationary such that its sole movement is the pre-travel.

BRIEF DESCRIPTION OF THE DRAWINGS

Embodiments of the inventive suction device are described in detail in connection with the following Figures, wherein:

FIG. 3 is a sectional top plan view along line III—III of FIG. 1;

FIGS. 4 and 5 are schematic side elevations of a second embodiment of the inventive suction device with a bending template arranged laterally distanced from the sucker in the same positions as in FIGS. 1 and 2;

DESCRIPTION OF PREFERRED EMBODIMENTS

Figure 1:
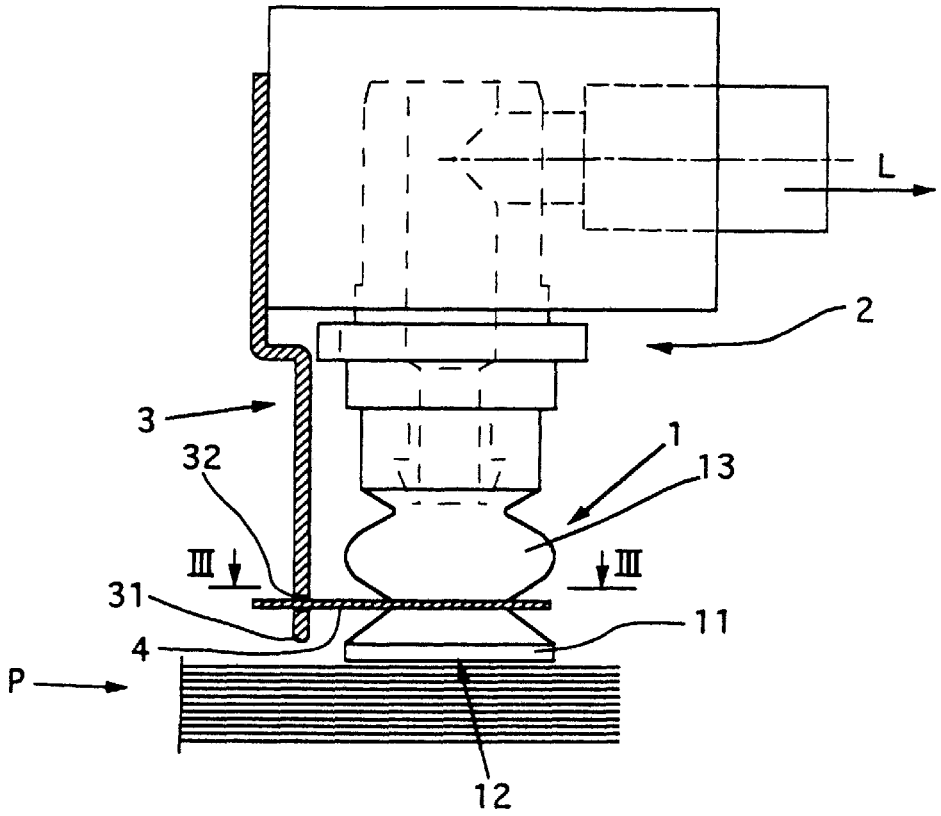
FIGS. 1 and 2 are schematic side elevations of a first embodiment of the inventive suction device with a bending template arranged laterally distanced from the sucker, viewed substantially parallel to a product to be gripped, in a position lowered onto the product to be gripped (suction lip in starting position, FIG. 1) and in a pre-travel position (FIG. 2)
Figure 2:
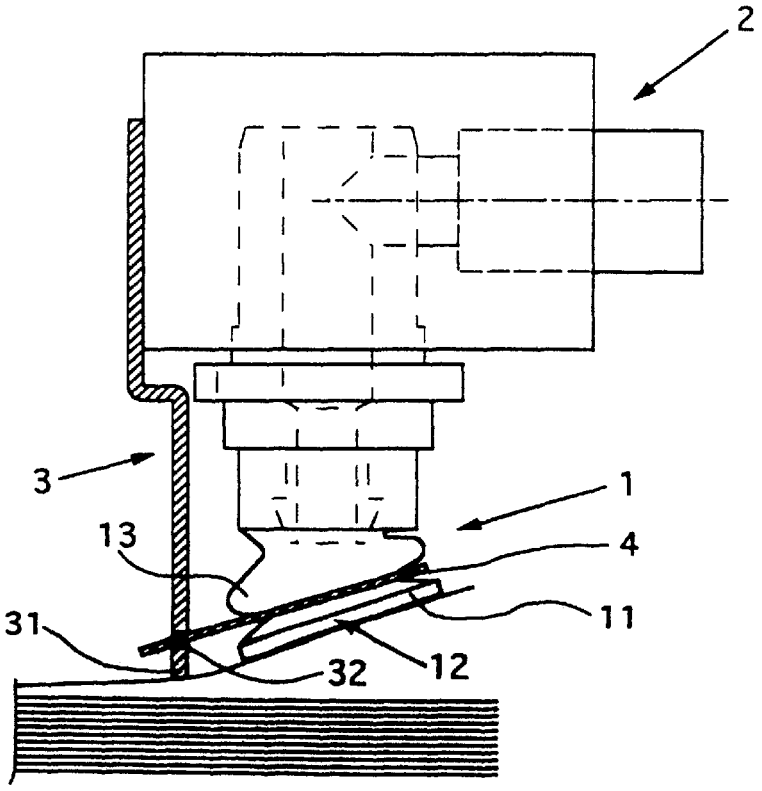

FIGS. 1 to 3 show an embodiment of the inventive suction device with a bending template at a point laterally spaced from the sucker. FIG. 1 shows the suction device lowered onto a stack of products to be gripped, FIG. 2 shows the suction device after completion of the pre-travel viewed substantially parallel to a product to be gripped. FIG. 3 shows the suction device in section (section line substantially parallel to a product to be gripped; III—III in FIG. 1).

The inventive suction device comprises a sucker 1 with a suction lip 11 which circumscribes a substantially plane suction opening 12 and is positionable on products P to be gripped. Sucker 1 is arranged on a movable end 2 of a suction line. Furthermore the inventive suction device comprises a bending template 3 arranged laterally distanced from the sucker 1 which bending template is movable together with the end 2 of the suction line, i.e. is e.g. fixed to it.

For the embodiments of the inventive suction device shown in FIGS. 1 to 3 sucker 1 comprises elastically compressible bellows 13. When the suction opening 12 is closed by a product to be gripped and air is sucked off through the suction line, a pressure depression develops in sucker 1, especially in bellows 13. Bellows 13 are designed such that a depression therein compresses the bellows, displacing suction lip 11 against the end of the suction line which displacement is the pre-travel. After the pre-travel, suction opening 12 is still substantially plane.

Bending template 3 comprises an advantageously rounded bending edge 31 on its free end which edge is laterally spaced from suction lip 11 and the position of which in direction of the pre-travel, lies substantially between the two extreme positions of the suction lip. This means that the distance from the bending edge to the end 2 of the suction line (or to any reference point on the end of the suction line respectively) is at a maximum the same as the distance between suction lip 11 and the end 2 of the suction line (or the same reference point respectively) when sucker 1 is in a relieved condition (starting position) and which distance is larger than the distance between suction lip 11 and the end 2 of the suction line when suction lip 11 is in its pre-travelled condition or which distance is at least the same as the largest of the latter distances (see next paragraph). Advantageously bending template 3 is positioned relative to the product to be gripped such that sucker 1 is nearer to a product edge than the bending edge 31, as can be seen from FIG. 3.

Furthermore, sucker 1 and bending template 3 can be connected by a connecting element 4 which is pivotally mounted in the area of the free end of bending template 3 and is connected substantially rigidly with sucker 1, e.g. by means of a guiding opening 41 in which sucker 1 is held in a positively engaged manner. Connecting element 4 controls the compression of sucker 1 such that in pre-travel position, the distance between the end of the suction line and the suction lip 11 is larger in an area facing towards the bending template 3 than in an opposite area (i.e. there are different distances between suction lip and end of the suction line—see previous paragraph). This kind of pre-travel position contributes to bending the product to be gripped in a precisely defined manner.

The pivotal connection between bending template 3 and connecting element 4 can e.g. be realized by means of a suitably wide slot 32 in the bending template 31, whereby a part of the connecting element 4 is stuck loosely through this slot 32.

FIG. 1 shows the beginning of a gripping cycle. The suction device is positioned such that suction lip 11 lies on the product to be gripped in a substantially relieved condition (starting position). Air is now sucked out (arrow L) of the sucker through the end of the suction line. As the suction opening 12 is closed by the product to be gripped a reduced pressure develops in the suction line by which bellows 13 are compressed causing the suction lip 11 to be displaced into its pre-travel position (FIG. 2). This happens without moving the end 2 of the suction line and forcibly coupled with the evacuation of sucker 1. By the effect of the pre-travel the product to be gripped is at least locally lifted off the stack.

As the position of bending edge 31 is not influenced by the pre-travel of suction lip 11 the product is bent around bending edge 31 during the pre-travel. This happens in a defined manner and with a smaller bending radius than this would be the case when carrying out a pre-travel without a bending template.

FIGS. 4 and 5 show a further embodiment of the inventive suction device shown in the same manner as the ones in FIGS. 1 and 2. This embodiment differs from the embodiment according to FIGS. 1 to 3 especially in the design of sucker 1 and the connection between bending template 3 and connecting element 4. Similar parts are marked with the same reference numbers as in FIGS. 1 to 3.

In the embodiment according to FIGS. 4 and 5, bellows 13 are designed like the bellows of an accordion. As connection between bending template 3 and connecting element 4 a hinge 33 consisting of a slot and a pin is provided. The cooperation of sucker 1 or suction lip 11 respectively and bending edge 31 by means of which cooperation the product to be gripped or the gripped product respectively is bent, is clearly visible from FIG. 5.

Figure 6:
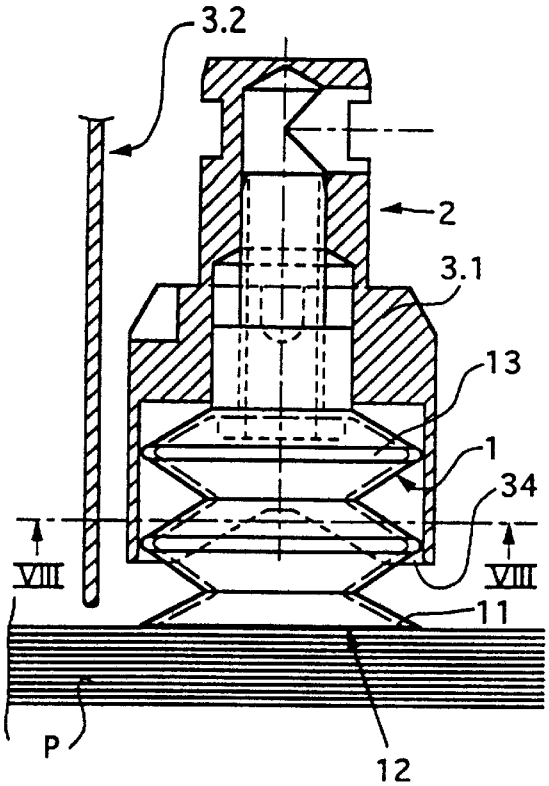
FIGS. 6 and 7 are schematic side elevations, in section, of a third embodiment of the inventive suction device with a suction lip-deforming bending template, viewed in the same positions as FIGS. 1 and 2.
Figure 7:
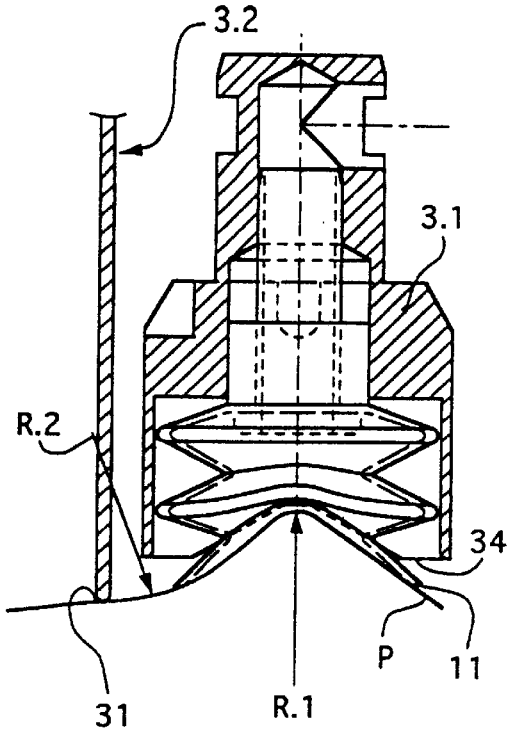
Figure 8:
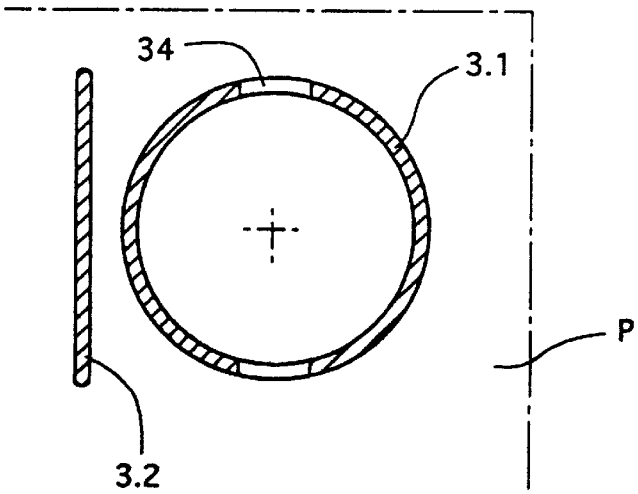
FIG. 8 is a transverse sectional view along line VIII—VIII of FIG. 6.

FIGS. 6 to 8 show a further embodiment of the inventive sucking device with a bending template 3.1 arranged in the area of the sucker which template deforms the suction lip such that the suction opening takes on a concave, bent form. Again, identical parts are designated with the same reference numbers as in he preceding figures.

FIG. 6 shows the suction device in a starting configuration, e.g. lowered onto a stack of products. Sucker 1 again comprises compressible bellows 13 and a suction lip 11, wherein suction lip 11 circumscribes a substantially plane suction opening 12. Sucker 1 is fitted to the end 2 of a suction line. The lip-deforming bending template 3.1 has e.g. the form of a cap being fastened to the end 2 of the suction line and being drawn over sucker 1 its lower deforming edge 34 facing away from the end of the suction line whereby the deforming edge lies on a bent surface.

FIG. 6 also shows an additional bending template 3.2 arranged laterally spaced from the sucker 1 which template corresponds regarding its function to the bending templates of FIGS. 1 to 5. This bending template 3.2 can also be absent.

FIG. 7 shows the suction device according to FIG. 6 after the pre-travel or after the compression of bellows 13 respectively. In this position the suction lip 11 is deformed by the deforming edge 34 of the lip-deforming bending template 3.1 such that the suction opening 12 is no longer plane but bent to be concave.

FIG. 7 also shows a product P gripped by the suction device. This product is bent substantially around a bending radius R.1 by the deformation of suction lip 11 and around a bending radius R.2 by bending edge 31 of bending template 3.2. The two bending radii are substantially opposed to each other.

FIG. 8 shows the suction device according to FIG. 6 in section perpendicular to the sucker axis (section line VIII—VIII in FIG. 6), i.e. cut in the area of the deforming edge 34 of the lip-deforming bending template 3.1. This Figure illustrates the channel-like bending of the deforming edge 34 and of the bent suction opening.

FIGS. 9*a* to 9*d* on the one hand show a further embodiment of the inventive suction device and on the other hand a complete cycle for gripping single products from a stack of products P.

The suction device according to FIGS. 9*a* to 9*d* does not comprise a connecting element. It is a suction device of the kind described in the mentioned German publication with which a bending template 3 is associated. Sucker 1 does not comprise elastically compressible bellows but a rigid sucker body 14 which is movably guided in the end 2 of a suction line. The description of sucker 1 and its connection to the end 2 of the suction line are contained in the mentioned German publication.

Figure 9A:
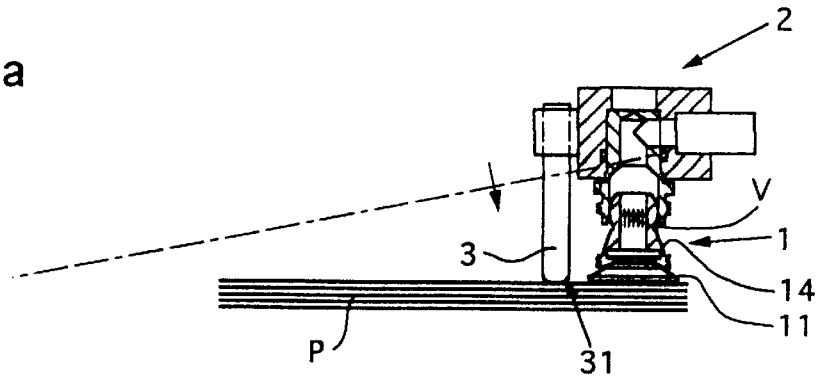
FIGS. 9*a*, 9*b*, 9*c* and 9*d* are schematic side elevations of a further embodiment of an inventive suction device in four successive phases of a cyclic movement for gripping single products from a stack.

FIG. 9*a* shows the suction device lowered onto a stack of products P. Suction lip 11 of sucker 1 can be pressed slightly onto the stack but is substantially in its starting position. As the bending edge 31 of the bending template 3 has substantially the same distance from the end 2 of the suction line as suction lip 11, bending edge 31 is also positioned on the product to be gripped. The sucker is now evacuated (arrows V) causing pre-travel and bending around bending edge 31.

Figure 9B:
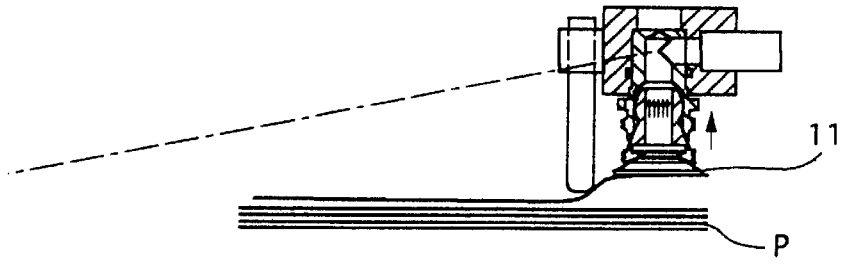

FIG. 9*b* shows the suction device with suction lip 11 in pre-travel position and lifted off the stack of products P as a whole. As the suction device has no connecting element, the suction lip 11 is shifted out of the starting position (FIG. 9*a*) in a parallel manner.

Figure 9C:
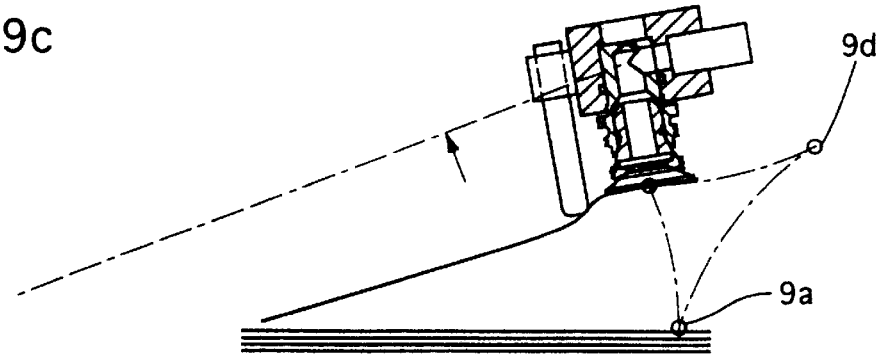
Figure 9D:
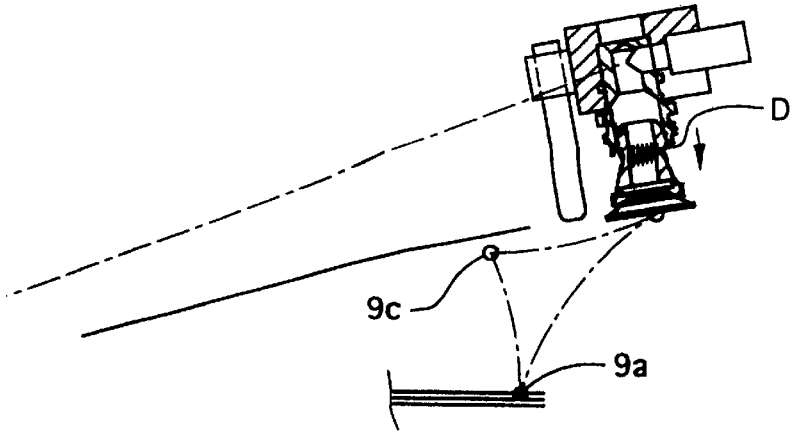

FIG. 9*c* shows the suction device in a position lifted totally off the stack and FIG. 9*d* shows the suction device in a position shifted even further in which position the suction lip returns to its starting position by pressure compensation in the sucker (arrows D) and the product is released. In both FIGS. 9*c* and 9*d* a typical cycle of movement of the suction device is shown with broken lines and the positions of the suction opening are marked with the numbers of the corresponding figures.

The product gripped by the suction device is gripped by further means, e.g. by a gripping device or a conveying belt, somewhere between the position of FIG. 9*c* and the position of FIG. 9*d* and it is conveyed away.

For adjusting the inventive suction device to different handling characteristics (stiffness, permeability) of products to be gripped it is advantageous if, apart from the suction effect, also the positions of the whole suction device relative to the products to be gripped and the position of the bending edge relative to the sucker and their distance from the end of the suction line are adjustable.

For suction devices with lip-deforming bending templates (FIGS. 6 to 8), it is advantageous to use bending templates with differently formed deforming edges when handling different types of products. If the lip-deforming bending template, as shown in FIGS. 6 to 8, has the form of a cap and can be drawn over the sucker it is very easily exchangeable.

I claim:

1. A suction device for handling light, flat and bendable articles, the suction device comprising:

a suction line;

a sucker at an end of said suction line, said sucker having a suction lip for individually contacting and lifting said articles, said suction lip comprising an elastically deformable material and having a relaxed position defining a suction opening lying generally in a plane; and a lip-deforming bending template having a deforming edge defining a concave shape, said suction lip and deforming edge being relatively displaceable so that said suction lip is deformed by contact with said deforming edge to define a suction opening substantially conforming to said concave shape.

2. A device according to claim 1 wherein said suction lip is retractable toward said suction line and said bending template is stationary relative to said suction line.

3. A device according to claim 2 wherein said sucker comprises an elastically compressible sucker body retracting said suction lip when said sucker is evacuated.

4. A device according to claim 2 wherein said sucker comprises a rigid sucker body displaceable in said end of said suction line.

5. A suction device according to claim 1 further comprising a second bending template laterally spaced from said suction lip and having a bending edge for contacting an article lifted by said suction lip, said suction lip being displaceable relative to said bending edge.

6. A suction device according to claim 5 wherein said second bending template is stationary relative to said end of said suction line.

7. A suction device according to claim 5 wherein said suction lip is movable relative to said bending edge.

8. A suction device according to claim 7 including a connecting element pivotably connected to said second bending template and substantially rigidly connected to said sucker.

9. A suction device according to claim 8 wherein said connecting element comprises a guiding opening positively engaging said sucker.

10. A suction device according to claim 8 wherein said second bending template comprises an opening for movably receiving said connecting element.

* * * * *